United States Patent [19]

Inoue et al.

[11] 4,122,935

[45] Oct. 31, 1978

[54] SYSTEM FOR CONTROLLING COIN-OPERATED LOCKERS

[75] Inventors: Komei Inoue; Tosihisa Kosaka, both of Himeji, Japan

[73] Assignee: Glory Kogyo Kabushiki Kaisha, Himeji, Japan

[21] Appl. No.: 749,615

[22] Filed: Dec. 10, 1976

Related U.S. Application Data

[63] Continuation-in-part of Ser. No. 593,042, Jul. 3, 1975, abandoned, which is a continuation of Ser. No. 423,798, Dec. 11, 1973, abandoned.

[30] Foreign Application Priority Data

Dec. 11, 1972 [JP] Japan ..... 47-124583

[51] Int. Cl.[2] ..... G07F 5/02

[52] U.S. Cl. ..... 194/32; 194/DIG. 18

[58] Field of Search ..... 194/9 T, 32, 51, 59, 194/65, DIG. 18, 1 R; 70/389, 267, 268, 269

[56] References Cited

U.S. PATENT DOCUMENTS

| | | | |
|---|---|---|---|
| 2,965,210 | 12/1960 | Stackhouse | 194/9 T |
| 3,773,158 | 11/1973 | Wada | 194/51 X |
| 3,841,458 | 10/1974 | Kinoshita | 194/32 |
| 3,917,046 | 11/1975 | Yorisue et al. | 194/9 T |

*Primary Examiner*—Joseph J. Rolla

*Attorney, Agent, or Firm*—Wenderoth, Lind & Ponack

[57] ABSTRACT

A system for controlling a coin-operated locker comprises a time-lapse detecting device which starts its operation upon locking of the locker for detecting the passing of a predetermined unitary period of time of use of the locker and a locking device for preventing the locker from being unlocked after the detection of the predetermined unitary period of time, whereby a rental fee is collected on the basis of the period of time for which the locker has been actually used.

2 Claims, 7 Drawing Figures

SYSTEM FOR CONTROLLING COIN-OPERATED LOCKERS

CROSS-REFERENCE TO A RELATED APPLICATION

This application is a continuation-in-part application of Application Ser. No. 593,042 filed July 3, 1975, now abandoned, which is a continuation of Application Ser. No. 423,798 filed Dec. 11, 1973, now abandoned.

BACKGROUND OF THE INVENTION

This invention relates to coin-operated rental lockers (hereinafter referred to as coin-lockers when applicable) and more particularly to a system for controlling a coin-locker.

Conventional coin-lockers are so designed that all of the coin-lockers which are used are rendered unopenable at a certain time instant, for instance at 12 o'clock midnight, regardless of the time from which the use of the coin-lockers has started, and after the certain time instant (12 o'clock midnight) the coin-lockers cannot be unlocked without paying an additional rental fee. Therefore, sometimes a user must pay a rental fee for two-day use to unlock the coin-locker even though it has been used for only one hour, for instance. Thus, the collection of rental fees in conventional coin-lockers is not always reasonable.

SUMMARY OF THE INVENTION

Accordingly, an object of this invention is to provide a system for controlling a coin-locker in such a manner that it will collect a rental fee strictly on the basis of the period of time for which the coin-locker is actually used.

The foregoing object and other objects have been achieved by the provision of a system for controlling a coin-locker which comprises a lock mechanism for locking and unlocking the locker, a locking detecting device for detecting the locking of the locker, a time-lapse detecting device which starts detecting the passing of a predetermined unitary period of time of use of the locker upon detection of the locking of the locker, and a locking device for preventing the locker from being opened after the detection of the passing of the predetermined unitary period of time, whereby a rental fee can be collected on the basis of the period of time for which the locker is actually used.

The nature, utility and principle of this invention will be more clearly understood from the following detailed description when read in conjunction with the accompanying drawings.

DETAILED DESCRIPTION OF THE INVENTION

Figure 1:
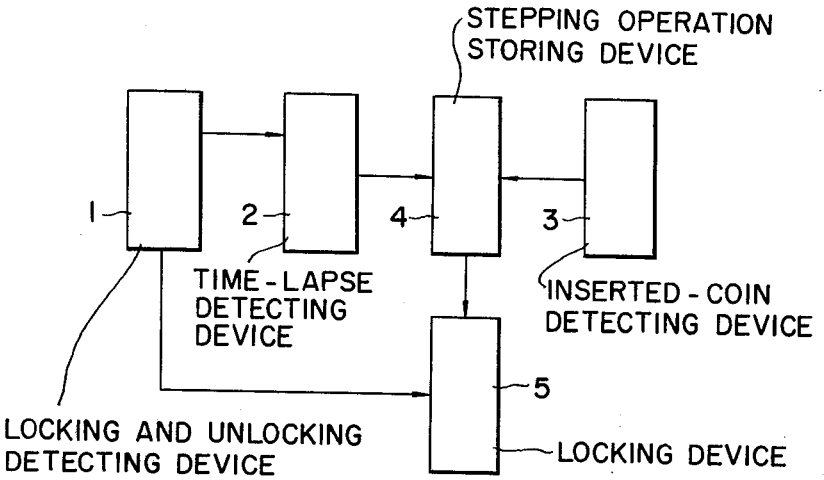
FIG. 1 is a block diagram illustrating the fundamental arrangement of a system for controlling a coin-locker according to this invention.

The fundamental arrangement of this invention as shown in FIG. 1 has a locking and unlocking detecting device 1 for detecting the locking and unlocking of a coin-locker. The device 1 is connected to a time-lapse detecting device 2, the operation of which is started by a locking operation, and the detecting device 2 produces a time-lapse signal at intervals of a certain period of time after the coin-locker has been locked.

The system shown in FIG. 1 further has an inserted coin detecting device 3 for detecting coins inserted in a coin inlet. These detecting devices 2 and 3 are connected to a stepping operation storing device 4 which operates to move an operating plate stepwise upward as will be described later, with the aid of the time-lapse signal from the time-lapse detecting device 2 and to move the operating plate downward with the aid of signals from the inserted-coin detecting device 3. The devices 1 and 4 are connected to a locking device 5 which is controlled by the locking and unlocking detecting device 1 and allows the coin-locker to be unlocked when a content stored in the stepping operation storing device 4 becomes zero.

Figure 2:
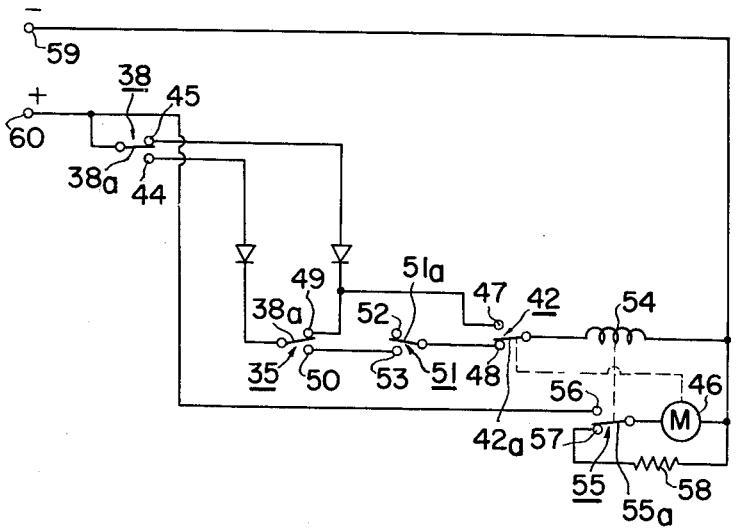
FIG. 2 is a schematic circuit diagram illustrating an electrical section of a first example of the invention.
Figure 3:
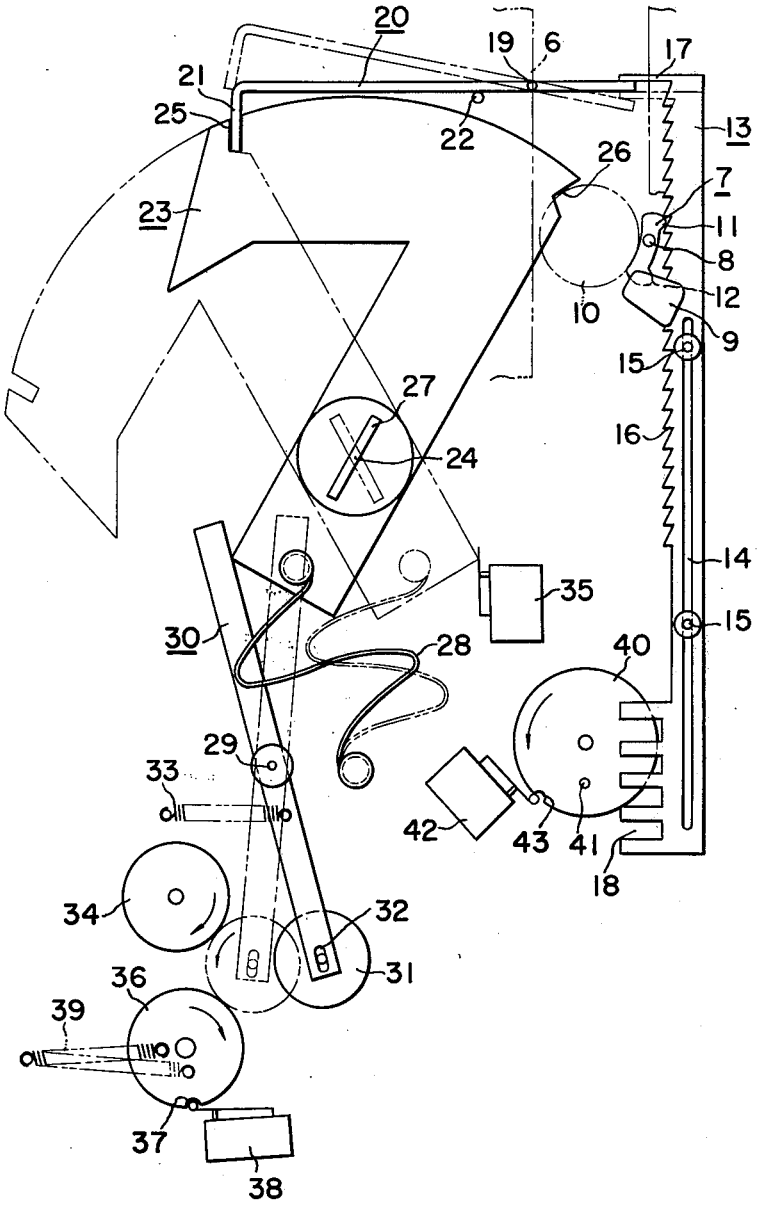
FIG. 3 is an explanatory schematic diagram for illustrating a mechanical section of the first example of the invention.

With reference to FIGS. 2 and 3 there is shown a first example of a system for controlling a coin-locker (hereinafter referred to as a control system when applicable) according to this invention.

Shown in FIG. 3 is a mechanical section of the control system which comprises a coin passage 6 provided in a coin-locker body (not shown) and a coin detecting lever 7 provided on a side of the coin passage 6. The lever 7 is pivotally mounted on a supporting shaft 8. A weight 9 is secured to the lower part of the lever 7 in a manner such that the lever 7 normally protrudes into the coin passage 6. In other words, when a coin 10 is dropped, it will depress the lever 7 against the action of the weight 9. The lever 7 had engaging pawls 11 and 12 in the upper and the lower parts thereof, respectively.

The control system further comprises an operating plate 13 which has a guide groove 14 arranged in its longitudinal direction and guide pins 15 fixed on the coin-locker body, so that the operating plate 13 is guided to move or slide vertically. On one side of the operating plate 13, there is formed a rack 16 which is alternately engaged with (or disengaged from) the engaging pawls 11 and 12 of the lever 7, whereby the plate 13 is moved stepwise upward or downward as will become more apparent later. This motion of the plate 13 will be referred to as a stepping operation hereinafter. Furthermore, the operating plate 13 is provided with an engaging arm 17 formed on its upper end and a plurality of engaging grooves 18 formed on one side of its lower end portion, as is shown in FIG. 3.

The engaging arm 17 is adapted to engage one end of a holding lever 20 which is pivotally mounted on a supporting shaft 19. The other end portion of this lever 20 is bent downward thereby forming an inverted-"L"-shaped holding arm 21. Reference 22 designates a stop pin provided for the holding arm 21.

The control system further comprises a locking lever 23 which is also pivotally mounted on a fulcrum 24. The locking lever 23 has holding notches 25 and 26 in its upper left and upper right portions, respectively. The holding notch 25 is adapted to engage with the holding arm 21 when the coin-locker is unlocked, while the holding notch 26 is adapted to engage with the same holding arm 21 when the coin-locker is locked. A keyhole 27 is provided in the locking lever 23 in such a manner that the center of the slot 27 is at the fulcrum 24 of the locking lever 23. An "S"-shaped spring 28 is provided between the lower end of the locking lever 23 and a stationary frame of the locker body. The spring 28 acts in two directions, that is, rightward and leftward, having a dead point at its center.

Below the locking lever 23 there is a roller lever 30 which is also pivotally mounted on a supporting shaft 29. The upper end portion of this roller lever 30 engages the lower end of the locking lever 23. The lower end portion of the roller lever 30 has a slot 32 in which the shaft of a transmission roller 31 is movably fitted. The roller lever 30, and accordingly the transmission roller 31, is urged in one direction by a coiled spring 33. The transmission roller 31 serves to transmit rotation of a timer roller 34, which is connected to a timer and makes one revolution in a predetermined length of time, 2 hours, for instance, to a cam 36. That is, the cam 36 is rotated through the transmission roller 31 at the same rotational speed as that of the timer roller 34.

An operating switch 35 for the timer roller 34 is disposed at a position in a manner such that the switch 35 is operated by the locking lever 23. The cam 36 has a recess 37 in its peripheral portion so as to operate a switch 38 which is provided to operate an electric motor (not shown in FIG. 3). Furthermore, the cam 36 is provided with a coiled spring 39 for restoring the roller 36 to its predetermined position. In the vicinity of the engaging grooves 18 of the operating plate 13, there is provided a cam 40 of the motor operated by the switch 38. This cam 40 is provided with a push-up pin 41 on its one side which operates to push the operating plate 13 upward by engaging with the engaging groove 18 and is further provided with a recess 43 in its peripheral portion which is adapted to operate a switch 42. The operations of the above-mentioned switches will become more apparent later.

Shown in FIG. 2 is an electrical circuit to operate the mechanical arrangement shown in FIG. 3 including the above-described switches 38, 42 and 35, and a switch 51.

A movable contact **38*a* of the switch 38 is tripped to a contact 45 from a contact 44 when the lever of the switch 38 is dropped into the recess 37 of the cam 36. A movable contact 42*a* of the switch 42 is tripped to a contact 48 from a contact 47 when the lever of the switch 42 is dropped into the recess 43 of the cam 40. The switch 35 is operated by the locking and unlocking of the coin-locker. That is, its movable contact 35*a* is tripped to a contact 49 when the coin-locker is unlocked and is tripped to a contact 50 when the same is locked. Furthermore, a movable contact 51*a* of the switch 51 is set on a contact 52 when a key is inserted in the keyhole 27 (FIG. 3) and is set on a contact 53 when the key is removed from the keyhole 27**.

The electrical circuit diagram further comprises a relay 54, a switch 55 operated by the relay 54, a braking resistor 58, and terminals 59 and 60 of a d.c. power source of 12 volts.

The coin-locker control system described above operates as follows. When the coin-locker is not used, the conditions of the control system are as indicated by solid lines in FIG. 3 and the key cannot be turned nor removed. Under these conditions, when a prescribed coin is inserted into a coin inlet, the coin is dropped through the coin passage 6 and the weight of the coin causes the coin detecting lever 7 to turn against the action of the weight 9. As a result, the engaging pawl 11 of the lever 7 is disengaged from the rack 16 so that the operating plate 13 falls by one pitch of the rack due to its own weight. Consequently, the holding lever 29 which has been engaged with the engaging arm 17 of the operating plate 13 is turned slightly around the supporting shaft 19 as is shown by the broken line in FIG. 3, and the holding arm 21 is therefore removed from the notch 25. Now, the coin-locker is ready to be opened.

Then, if, after baggage has been placed in the coin-locker, the door is closed and locked by turning the key and the key is removed from the keyhole, the locking lever 23 is turned as is shown by the broken line, and simultaneously the switch 35 is closed.

On the other hand, the timer is maintained operating at all times, and the timer-roller 34 rotates in the direction of the arrow. When the locking lever 23 is turned counterclockwise as was described above, the roller lever 30 is turned around the fulcrum 29 as shown by the broken line due to the action of the spring. As a result, the transmission roller 31 is moved leftward to contact the timer-roller 34 and the cam 36, and the rotation of the timer-roller 33 is therefore transmitted through the transmission roller 31 to the cam roller 36. Accordingly, whenever the cam 36 makes on revolution, the lever of the switch 38 is dropped into the recess 37 of the cam 36 and the movable contact **38*a* of the switch 38 is tripped to the contact 45. It should be noted that, before the cam 36** completes one full revolution, it is possible to open the door with the key to take the baggage out of the coin-locker.

However, since the cam 36 is thus kept turning, the lever of the switch 38 is raised on the circumferential surface of the cam 36 and the movable contact **38*a* of the switch 38 is therefore tripped to the contact 44. At this moment, since the movable contact 42*a* of the switch 42 has been tripped to the contact 48, the relay 54 is energized, as a result of which, the movable contact is tripped to the contact 56 and the motor 46** is therefore rotated.

The lever of the switch 42 which has been dropped into the recess 43 is raised on the circumferential surface of the cam 40 by the rotation of the motor 46, and the movable contact **42*a* of the switch 42 is therefore tripped to the contact 47 from the contact 48. As a result, the motor 46 is stopped, the relay is deenergized, and the cam 40** is also stopped.

When the lever of the switch 38 is dropped into the recess 37 of the cam 36 after a certain period of time, the movable contact **38*a* of the switch 38 is tripped to the contact 45 and the motor 46 is therefore rotated again. Accordingly, the push-up pin 41 of the cam 40 is engaged with one of the engaging grooves 18, and the operating plate 13 is therefore moved upward by one pitch of the rack and is held thereby by means of the engaging pawl 11 of the lever 7**.

Thereafter, when the motor 46 completes one revolution, the lever of the switch 42 is dropped into the recess 43 of the cam 40 and the movable contact **42*a* is therefore tripped to the contact 48. As a result, the relay 54 is deenergized to trip the movable contact 55*a* of the switch 55 to the contact 57, and the motor 46** is therefore braked to be quickly stopped.

When, after the motor 46 has stopped, the lever of the switch 38 is raised on the circumferential surface of the cam 36, the relay 54 is energized through the switches 38, 35, 51 and 42 and the motor 46 is rotated again. Accordingly, the lever of the switch 42 is raised to the circumferential surface of the cam 40, and the movable contact 42*a* of the switch 42 is tripped to the contact 47. As a result, the motor is stopped and is kept stopped until the movable contact 38*a* of the switch 38 is tripped again.

Thereafter, the operating plate 13 is raised by one pitch in the same manner as described at intervals of the predetermined period of time.

If, in order to take the baggage out of the coin-locker, a prescribed number of appropriate coins are inserted into the coin inlet, the operating plate 13 falls by one pitch due to the interaction of the coin detecting lever 7 and the weight 9. When the operating plate 13 falls to its lowermost position, the holding lever 20 is held as shown by the broken line, while a time-lapse indication on the coin-locker becomes "zero". Accordingly, it is now possible to turn the locking lever 23 with the key to the position shown by the solid line.

Upon turning of the locking lever 23 to the position shown by the solid line, the movable contact 35*a* of the switch is tripped to the contact 49 from the contact 50 to stop the timer-roller 34, while the roller-lever 30 is turned counterclockwise to the position indicated by the solid line against the action of the spring 33. As a result, the transmission roller 31 separates from the timer-roller 34, and the cam 36 is therefore restored to its initial condition by the spring 39, while the movable contact 38*a* of the switch 38 is therefore tripped to the contact 45.

Since the movable contact 38*a* is thus tripped and the movable contact 42*a* of the switch 42 has been tripped to the contact 47 in advance, it follows that the relay 54 is energized and the motor 46 is rotated. When the motor 46 completes one revolution, the lever of the switch 42 is dropped into the recess 43 of the cam 40 and the motor 46 is therefore stopped. By one revolution of the cam 40, the operating plate 13 is moved upward by one pitch of the rack, and the holding arm 21 of the lever 20 is engaged with the notch 25 of the locking lever 23 so that the locking lever 23 cannot be turned. Thus, the coin-locker becomes ready for the next use.

Figure 4:
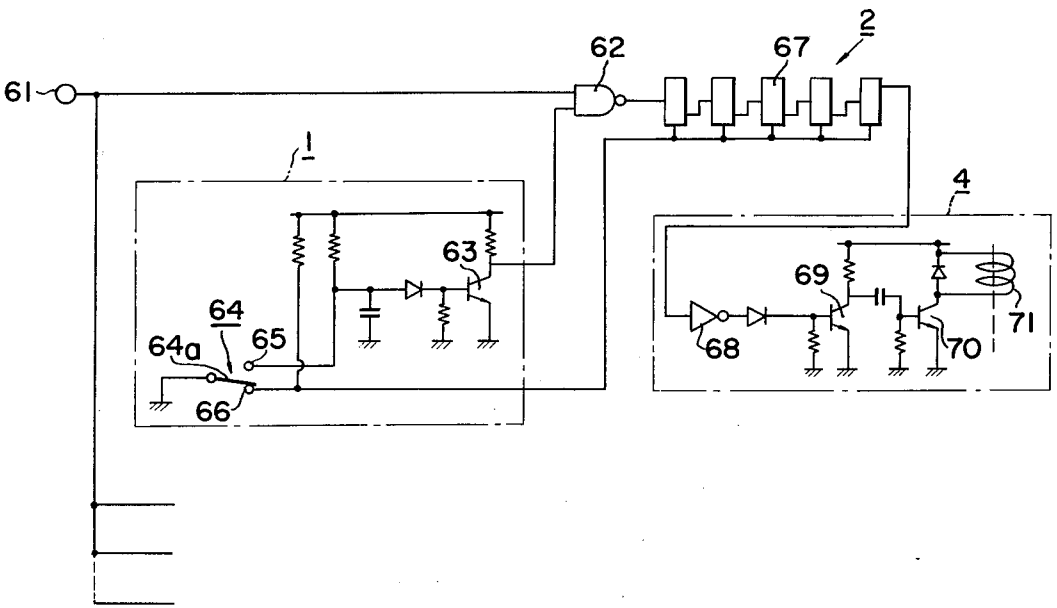
FIG. 4 is a schematic circuit diagram illustrating an electrical section of a second example of the invention.

One modification of the electrical section of the control system according to this invention will be described with reference to FIG. 4, which comprises a gate circuit 62 with an input terminal 61 to which a pulse signal is applied from a pulse generator (not shown) at intervals of five minutes. To the other input of the gate circuit 62, a locking and unlocking device 1 is connected. The device 1 operates to apply a set signal to the gate circuit 62 when the coin-locker is locked. The device 1 comprises a transistor 63, resistors, a capacitor, and a switch 64 whose movable contact 64*a* is tripped to a contact 65 when the coin-locker is locked and to a contact 66 when the coin-locker is unlocked.

To the output of the gate circuit 62, a time-lapse detecting device 2, that is, a divide-by-24 counter, is connected. The counter produces an output signal employed to stepwise move the operating plate 13 (FIG. 3) (hereinafter referred to as a stepping signal when applicable) when it has counted twenty-four pulses produced from the pulse generator. The reset side of the counter 67 is connected to the contact 66 of the switch 64.

To the output side of the counter 2 a stepping operation storing device 4 is connected. The device 4 comprises an inverter circuit 68, transistors 69 and 70, resistors, a capacitor, and a relay 71. Wenever a stepping signal is applied to the device 4, the relay 71 is energized thereby to perform the stepping operation of the operating plates 13 (FIG. 3) at intervals of 2 hours.

The operation of the circuit shown in FIG. 4 will now be described. Pulses are delivered to the control system from the pulse generator at all times regardless of whether or not the coin-locker is used. When the coin-locker is loaded with baggage and is locked, the movable contact 64*a* of the switch 64 is tripped to the contact 65, and the transistor 63 is therefore randered non-conductive thereby to produce a set signal which is continuously applied to the gate circuit 62 during the period the coin-locker is used.

Accordingly, pulses from the pulse generator are applied through the gate circuit 62 to the counter 67. Upon counting of twenty-four pulses, the counter delivers the stepping signal to the device 4. As a result, the transistor 70 becomes conductive, and the relay 71 is therefore energized to rotate the motor. Consequently, the stepping operation of the operating plate 13 (FIG. 3) is carried out.

In order to take the baggage out of the coin-locker, a prescribed number of appropriate coins are inserted into the coin inlet. Then, the operating plate 13 is moved downward as was described before while the time-lapse indication on the coin-locker becomes "zero", and the coin-locker can be opened.

Figure 6:
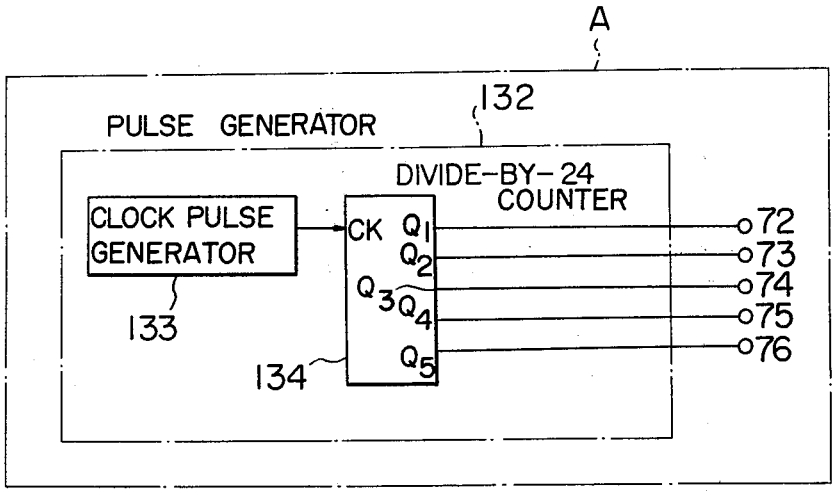
FIG. 6 is a block diagram illustrating a first time-lapse detecting means shown in FIG. 5.
Figure 7:
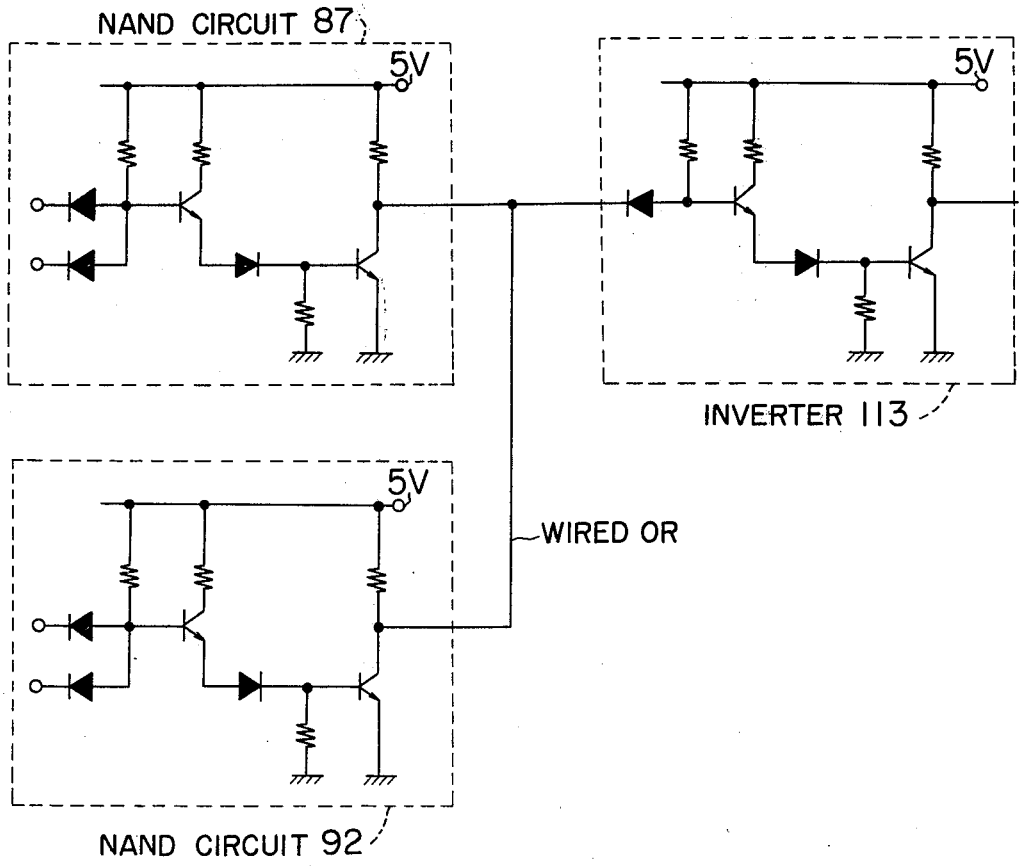
FIG. 7 is an explanatory diagram for a description of comparison means shown in FIG. 5.

Another example of the electrical section of the control system according to this invention will be described with reference to FIGS. 5, 6 and 7. This electrical section comprises a first time-lapse detecting means A with terminals 72 through 76 to which a pulse generator 132 is connected. The pulse generator 132, as shown in FIG. 6, comprises a clock pulse generator 133 and a divide-by-24 counter 134 connected to the clock pulse generator 133, to deliver output data listed in Table 1 below to the terminals 72 through 76 at intervals of a predetermined period of time, for instance 5 minutes.

Table 1

| Count value | Output data | | | | |
|---|---|---|---|---|---|
| | $Q_5$ | $Q_4$ | $Q_3$ | $Q_2$ | $Q_1$ |
| 0 | 0 | 0 | 0 | 0 | 0 |
| 1 | 0 | 0 | 0 | 0 | 1 |
| 2 | 0 | 0 | 0 | 1 | 0 |
| 3 | 0 | 0 | 0 | 1 | 1 |
| 4 | 0 | 0 | 1 | 0 | 0 |
| \| | | | | | |
| 22 | 1 | 0 | 1 | 1 | 0 |
| 23 | 1 | 0 | 1 | 1 | 1 |
| 0 | 0 | 0 | 0 | 0 | 0 |
| 1 | 0 | 0 | 0 | 0 | 1 |
| \| | | | | | |

More specifically, the clock pulse generator 133 operates to produce one pulse signal for every five minutes, while the divide-by-24 counter 134 operates to count the pulse signals applied to its terminal CK, and outputs its counted value as 5-bit binary data through its output terminals $Q_1$, $Q_2$, $Q_3$, $Q_4$ and $Q_5$ which are connected respectively to the terminals 72, 73, 74, 75 and 76. Thus, one operation cycle of the divide-by-24 counter 134 is completed in 2 hours (=5 minutes × 24).

Figure 5:
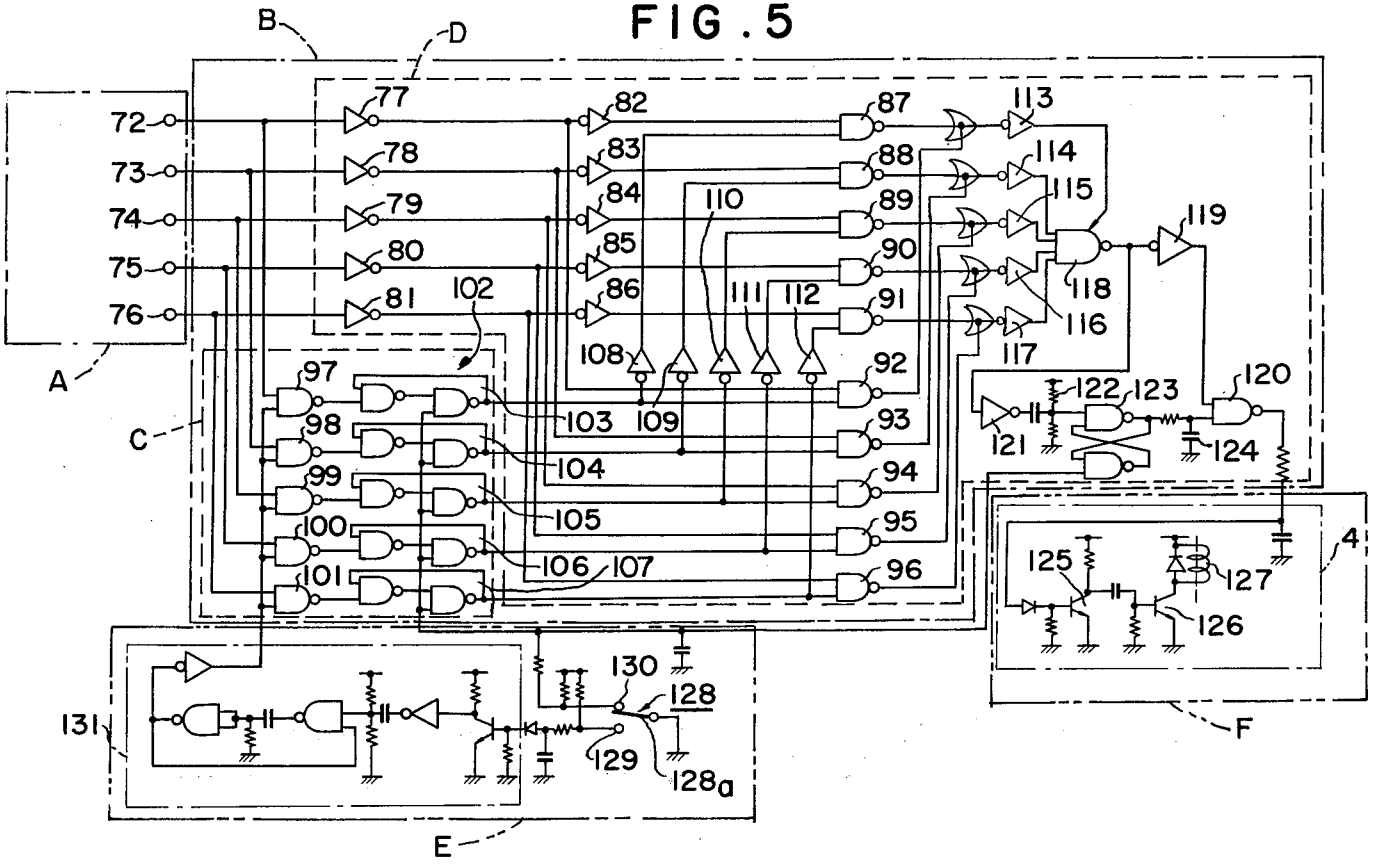
FIG. 5 is a schematic circuit diagram illustrating an electrical section of a third example of the invention.

The electrical section further comprises a second time-lapse detecting means B including a memory means C and a comparison means D as shown in FIG. 5.

The memory means C comprises NAND circuits 97 through 101 connected respectively to the terminals 72 through 76, and a memory circuit 102 made up of flip-flop circuits 103 through 107 connected to the NAND circuits 97 through 101. Each of the flip-flop circuits 103 through 107 is a conventional R-S type flip-flop circuit consisting of two 2-input NAND circuits.

In the comparison means D NAND circuits 87 through 91 are connected through inverter circuits 82 through 86 and inverter circuits 77 through 81 to the afore-mentioned terminals 72 through 76, and NAND circuits 92 through 96 are connected through the inverter circuits 77 through 81 to the input terminals 72 through 76, and the output terminals of the flip-flop circuits 103 through 107 in the memory means C are connected through inverter circuits 108 through 112 to the NAND circuits 87 through 91, respectively. The outputs of NAND circuits 87 through 91 are connected to the outputs of NAND circuits 92 through 96 by wired OR circuits.

As conducive to a full understanding of this connection, the connection of the NAND circuits 87 and 92 and an inverter circuit 113 (described later) will be described, as a typical example, in detail with reference to FIG. 7. The circuit arrangement of these NAND circuits may be of the conventional TTL (Transistor-Transistor-Logic) or DTL (Transistor-Diode-Logic). In FIG. 7, the DTL is employed. In this example, a "0" level signal is a low level signal and means 0 volt, while a "1" level signal is a high level signal and means 5 volts. When at least one of the NAND circuits 87 and 92 outputs the "0" level signal, the "0" level signal is inputed to the inverter circuit 113.

The outputs of the NAND circuits 87 through 91 and the NAND circuits 92 through 96 thus connected are connected through inverter circuits 113 through 117 to a NAND circuit 118. The output of the NAND circuit 118 is connected through an inverter circuit 119 to a NAND circuit 120, and is connected through an inverter circuit 121, a differential circuit 122, and a memory circuit 123 to the aforementioned NAND circuit 120.

The electrical section of the control system according to the invention, as shown in FIG. 5, further comprises a locking detecting means E, and a locking means F.

The locking means F is provided for preventing the unlocking operation of the coin locker with the aid of the output of the NAND circuit 120 in the second time-lapse detecting means B. The locking means comprises a stepping operation storing device 4 including a relay 127 which is connected through transistors 125 and 126 to the output of the NAND circuit 120. The stepping operation storing device 4 is adapted to operate the operating plate 13 (FIG. 3) stepwise.

The locking detecting means E comprises: a switch 128 with a movable contact **128*a* which is tripped to a contact 129 when the locker is locked, and is tripped to a contact 130 when the locker is unlocked; and a monostable multivibrator circuit 131 connected to the contact 129 for delivering a set signal. The monostable multivibrator circuit 131 is further connected to the NAND circuits 97 through 101 in the memory means C. The contact 130 of the switch 128 is connected to the memory circuit 102 in the memory means C and to the memory circuit 123** in the comparison means D as a memory circuit reset means.

The operation of the electrical section shown in FIG. 5 will be described.

It is assumed that pulse signals "1", "1", "0", "0" and "0" in the third group (in Table 1) are applied, as a timer signal, to the terminals 72 through 76 by the pulse generator, respectively. If, under this condition, the locker is loaded with baggage and is locked, the movable contact **128*a* of the switch 128 is tripped to the contact 129, and therefore a pulse signal is applied to the NAND circuits 97 through 101 by the monostable multivibrator circuit 131. As, in this operation, the timer signal is applied to these NAND circuits 97 through 101 through the terminals 72 through 76 as was described, output signals "0", "0","1","1" and "1" are produced by the NAND circuits 97 through 101, respectively, and therefore output signals "0","0","1","1" and "1" are produced by the flip-flop circuits 103 through 107 in the memory circuit 102, respectively. These output signals are applied directly to the NAND circuits 92 through 96, and are, on the other hand, inverted into signals "1","1","0","0" and "0" by the inverter circuits 108 through 112, which are applied to the NAND circuits 87 through 91**, respectively.

On the other hand, the signals "1","1","0","0" and "0" from the terminals 72 through 76 are applied through the inverters 77 through 81 to the NAND circuits 92 through 96, and are applied through the inverters 77 through 81 and through the inverters 82 through 86 to the NAND circuits 87 through 91, respectively. Output signals "0","0","1", "1", and "1" and "1","1","0","0", and "0" are produced by the NAND circuits 87 through 91 and the NAND circuits 92 through 96, respectively. The output signals of NAND circuits 87 through 91 are combined with the output signals of NAND circuits 92 through 96 by the previously described wired OR circuits. The wired OR circuits produce outputs of "0", "0", "0", "0" and "0". These output signals are inverted by the inverter circuits 113 through 117, as a result of which an output "0" is produced by the NAND circuit 118, and an output "1" is applied to the NAND circuit 120 by the inverter 119. On the other hand, an output "1" is produced by the inverter 121, and therefore no differential pulse is produced by the differential circuit 122 and no storage operation is effected by the memory circuit 123. Accordingly, no stepping pulse is produced by the NAND circuit 120.

When it has passed five minutes since the time when the pulse signals "1","1","0","0" and "0" were inputted through the terminals 72 through 76, pulse signals "0","0","1","0", and "0" in the fourth group are applied to the second time-lapse detecting means B. Therefore, in the comparison means D signals "1","1","0","1", and "1" are applied to the NAND circuits 92 through 96 through the inverters 77 through 81, respectively, and signals "0","0","1","0", and "0" are applied to the NAND circuits 87 through 91 through the inverters 82 through 86, respectively.

On the other hand, as the signals "0","0","1","1",and "1" are outputted by the NAND circuits 103 through 107 in the memory means C, the NAND circuits 87 through 91 and the NAND circuits 92 through 96 produce output signals "1","1","1","1" and "1" and output signals "1","1","1","0" and "0", respectively. Through the aforesaid wired OR circuits the "1", "1", "1", "0", and "0" are applied to the inputs of the inverters 113 through 117, respectively. Accordingly, a signal "1" is outputted by the NAND circuit 118, and is stored in the memory circuit 123 through the inverter 121 and the differential circuit 122. The signal thus stored, after being delayed by the delay circuit 124, is applied to the NAND circuit 120, that is the signal "1" is applied to the NAND circuit 120. However, since the signal "0" is outputted by the inverter 119, no stepping pulse is produced.

After the lapse of 2 hours, pulses signals "1","1", "0","0", and "0" in the third group are applied to the terminals 72 through 76 again, and these data are compared with the data stored in the memory means C. If these data are coincident, a signal "0" is outputted by the NAND circuit 118 and a signal "1" is delivered from the inverter 119 to the NAND circuit 120. As the signal "1" is outputted by the memory circuit 123, a stepping pulse at a "0" level is applied by the NAND circuit 120 to the stepping operation storing device 4 in the locking means F. As a result, the relay 127 is energized and the first stepping operation of the stepping plate 13 (FIG. 3) is carried out.

Thereafter, the stepping operation is carried out in the same manner every 2 hours.

In order to take the baggage out of the coin-locker, a necessary number of specified coins are inserted into the coin inlet. Then, the stepping operation of the operating plate is reversely carried out, and when the time-lapse indication on the coin locker becomes "zero", the coin locker can be unlocked. Thereupon, the movable contact 128*a* of the switch 128 is tripped to the contact 130, applying a "0" signal to memory circuits 102 and 123 as a result of which the contents of memory circuits 102 and 123 changed into the reset condition, and the coin-locker becomes ready for the next use.

While, in the embodiments of the invention described above, counting of a rental fee for use of the coin-locker is started at the time when the key is turned to lock the coin locker, these examples may be modified so that the counting of the rental fee is started at the time when the key is removed from the keyhole, that is, they may be modified so that the rotation of the timer-roller 34 is transmitted to the cam 36 by the removal of the key from the keyhole. It should be noted, therefore, that the locking operation includes the operations also in which the key is turned and removed from the keyhole for locking the coin-locker.

The timer may be provided for each of the coin-lockers, or only one timer may be provided so as to control a plurality of coin-lockers.

As is apparent from the above descriptions, the coin-locker control system according to this invention, carrying out its control operation, or the stepping operation of the operating plate, at intervals of a certain period of time, allows the coin-locker to collect a rental fee for a period of time for which it has been actually used.

What is claimed is:

1. In a coin-operated locker which is locked by the use of a coin and is unlocked by a key which is lent to a user when the locker is locked, a system for controlling said coin-operated locker, said system comprising:

(a) lock mechanism for locking and unlocking said coin-operated locker;

(b) locking detecting means for detecting the fact that said locker has been locked;

(c) a first time-lapse detecting means comprising a timer roller which makes one revolution per a predetermined period of time;

(d) a second time-lapse detecting means comprising a roller which when said locker has been locked is connected to and turned by said timer roller of said first time-lapse detecting means, and a switch for detecting the fact that said roller has rotated for said predetermined period of time starting from the locking of said locker, to produce a time-lapse signal;

(e) connecting means for operatively connecting, when said locking detecting means has detected the locking of said locker, said roller of said second time-lapse detecting means to said timer roller of said first time-lapse detecting means; and (f) locking means, operable by said time-lapse signal produced by said second time-lapse detecting means, for preventing the unlocking operation of said lock mechanism, whereby said second time-lapse detecting means is operated starting from the locking of said locker to detect the lapse of time in use of said locker, and unlocking of said locker is controlled by said time-lapse signal produced by said second time-lapse detecting means.

2. In a coin-operated locker which is locked by the use of a coin and is unlocked by a key which is lent to a user when the locker is locked, a system for controlling said coin-operated locker, said system comprising:

(a) lock mechanism for locking and unlocking said coin-operated locker;

(b) locking detecting means for detecting the fact that said locker has been locked;

(c) a first time-lapse detecting means for detecting the lapse of time and for respeatedly producing time information at predetermined time intervals;

(d) a second time-lapse detecting means comprising memory means for storing time information which is produced by said first time-lapse detecting means when said locking detecting means detects the locking of said locker, and comparison means for, after said memory means has stored said time information, comparing said time information thus stored with time information produced by said first time-lapse detecting means, and when the time information stored in said memory means coincides with the time information produced by said first time-lapse detecting means, for producing a coincidence signal; and (e) locking means, operable by said coincidence signal produced by said second time-lapse detecting means, for preventing the unlocking operation of said lock mechanism, said second time-lapse detecting means being operated starting from the locking of said locker to detect the lapse of time in use of said locker, and unlocking of said locker being controlled by said coincidence signal produced by said second time-lapse detecting means.

* * * * *